US007625228B2

(12) United States Patent
Doumani

(10) Patent No.: US 7,625,228 B2
(45) Date of Patent: Dec. 1, 2009

(54) ANTI-DISENGAGEMENT CORD CONNECT FOR A POWER TOOL

(75) Inventor: Robert Doumani, Hoffman Estates, IL (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/897,328

(22) Filed: Aug. 30, 2007

(65) Prior Publication Data

US 2008/0054743 A1 Mar. 6, 2008

(51) Int. Cl.
*H01R 13/648* (2006.01)

(52) U.S. Cl. ..... 439/384; 439/568

(58) Field of Classification Search ..... 439/368–369, 439/247–248, 384, 568; D13/133
See application file for complete search history.

(56) References Cited

U.S. PATENT DOCUMENTS 3,611,265 A * 10/1971 Shurtz ..... 439/369
3,613,046 A * 10/1971 Kirk ..... 439/369
4,719,379 A * 1/1988 Daniels et al. ..... 310/71
7,175,456 B2 * 2/2007 Moreno et al. ..... 439/248

* cited by examiner

*Primary Examiner*—Edwin A. Leon
*Assistant Examiner*—Vanessa Girardi
(74) *Attorney, Agent, or Firm*—Greer, Burns & Crain, Ltd.

(57) ABSTRACT

Embodiments are disclosed of an anti-disengagement assembly for minimizing disengagement of an electrical extension cord from a power tool of the type that includes a housing and a motor therein, the assembly including an electrical plug module configured to engage a receptacle of the extension cord, with the plug module being operatively connected to the power tool motor and being mounted in the housing and being biased by at least one spring in a configuration permitting limited movement that reduces the influence of vibration produced by the power tool on the plug module.

14 Claims, 11 Drawing Sheets

ANTI-DISENGAGEMENT CORD CONNECT FOR A POWER TOOL

BACKGROUND OF THE INVENTION

Electronic devices such as power tools often include an electrical plug module for coupling with an electrical extension cord, thereby permitting an operator to use the power tool at locations remote from the nearest available electrical outlet. One common configuration for such a system is to include the electrical plug module within a recess of the housing such that prongs of the electrical plug module are accessible to engage the female receptacle disposed on the electrical extension cord. Thus, the electrical extension cord may be coupled to the recessed electrical plug module, with the coupling being at least partially hidden from view and at least partially protected within the power tool housing from becoming dislodged.

However, nearly all power tools produce some jarring and/or vibration of the power tool during operation, which in turn jars and vibrates the coupling between the electrical plug module and the electrical extension cord. The jarring/vibration causes the electrical plug module to vibrate at a different frequency than the extension cord. Due to the different relative vibration, the electrical plug module and electrical extension cord may become at least partially if not totally disengaged from one another, resulting in a loss of power to the power tool and possibly damaging the connection due to electrical arcing, interrupting its operation and usually aggravating the operator.

A retaining clip may be added, which is attached to the same handle/body in which the electric plug module is mounted. When provided, the retaining clip is also configured and arranged to make contact with the extension cord. The retaining clip will thereby transfer to the extension cord the vibration frequency of the handle/body that contains the plug module. The connection will reduce the effect of relative vibration and help prevent the cord from backing out. However, due to the wide range of extension cord female plug shapes, the retainer clip may make the female plug insertion difficult and may aggravate the operator. In addition, some plug shapes may not be as effective as others. The elimination of the retainer clip is desirable from an operator prospective.

In addition, where the power tools are portable, and are releasably coupled to an extension cord, inadvertent pulling or catching of the extension cord may cause the extension cord to become disengaged. For example, operators will frequently though inadvisably handle the power tool by the extension cord, and often times the weight of the power tool itself is greater than the amount of force required to disengage the extension cord from the tool. Other times the extension cord will become caught or snagged on a portion of the work surface or other part of the environment, and as the operator moves the power tool during operation, the operator inadvertently pulls the power tool away and disengages from the extension cord.

SUMMARY OF THE INVENTION

Embodiments of the invention provide an anti-disengagement assembly that minimizes vibration and disengagement of an electrical extension cord from a recessed electrical plug module disposed within a housing of a power tool. In a first preferred embodiment, axial vibration is reduced by a pair of biasing elements, which are disposed at opposing ends of the plug module, permitting a range of free movement of the plug module, where the plug module "floats" between the biasing elements. In a second preferred embodiment, axial vibration is absorbed by a plug module having a shape that is configured to permit at least limited rotation within the housing of the power tool. Additionally, a single biasing member is preferably provided in the second preferred embodiment to maintain the position and orientation of the plug module, as well as isolating the plug module from vibration. Still other embodiments of the invention include an anti-disengagement assembly

DETAILED DESCRIPTION OF THE INVENTION

Figure 1:
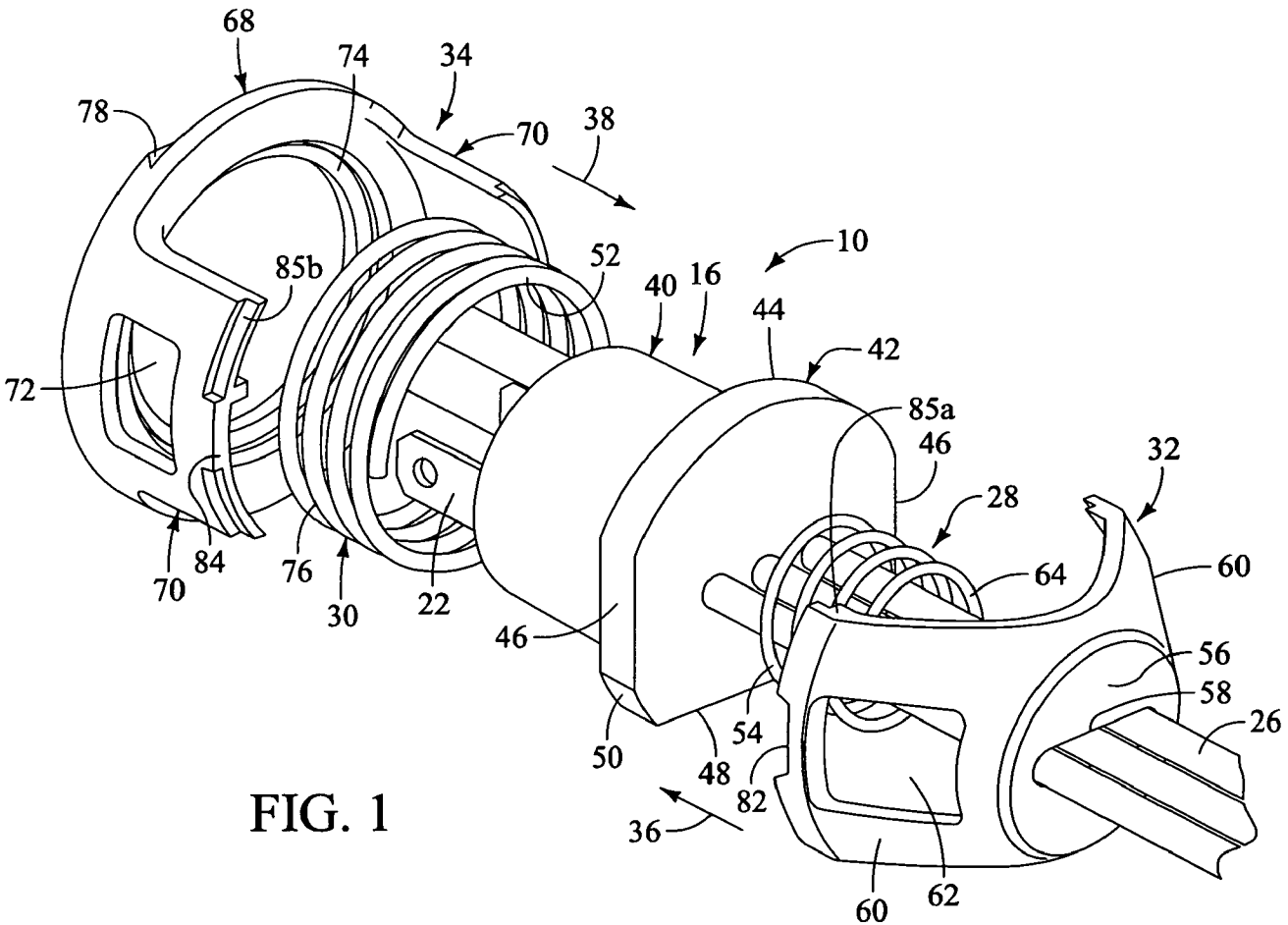
FIG. 1 is an exploded perspective view of an anti-disengagement assembly according to a first preferred embodiment of the invention.

Embodiments of the present invention include an anti-disengagement assembly for minimizing vibration induced disengagement of an electrical extension cord from an electrical plug module of a power tool. Other embodiments of the invention include an anti-disengagement assembly for minimizing disengagement of an electrical extension cord from an electrical plug module resulting from both vibration induced disengagement as well as inadvertent pulling or catching of the extension cord from the electrical plug module.

By providing one or more biasing members in close proximity to the plug module, the biasing members absorb tool vibration, thereby permitting movement of the plug module that is independent of the movement of the tool. In combination with one or more biasing members, other embodiments may include a cord retaining system that releasably retains a portion of the cord in close proximity to a tool housing to reduce the possibility that the extension cord will be inadvertently pulled or snagged. While it is contemplated that the invention may be used in connection with any electrical device, the preferred embodiments are used in connection with power tools, either hand held portable such as a circular saw or stationary such as a table saw, for example.

In the first preferred embodiment, opposing biasing members are provided at each end of a plug module, permitting the plug module to "float" between the biasing members. Vibration of the power tool during operation is absorbed by the biasing members, providing for the free movement of the plug module independent of any movement of tool or tool components. Thus, an extension cord will move with the plug module, thereby limiting the impact of tool vibration on the coupling of the plug module and the extension cord.

Turning therefore to FIGS. 1-4, a first preferred embodiment of the anti-disengagement assembly, designated generally at 10, is illustrated with a portion of a circular saw housing, designated generally at 12, of the type that includes a motor (not shown) and a recessed electrical plug module 16 disposed within the housing. While the electrical plug module 16 may be configured and arranged pursuant to manufacturing specifications, the plug module 16 is preferably recessed within a hollow generally cylindrical chamber portion 20 of the housing 12 such that prongs 22 of the plug module extend outwardly toward an opening 24 in the chamber portion while electrical wires 26 extend oppositely to operatively connect the plug module to a switch (not shown) which connects it to the motor.

Figure 2:
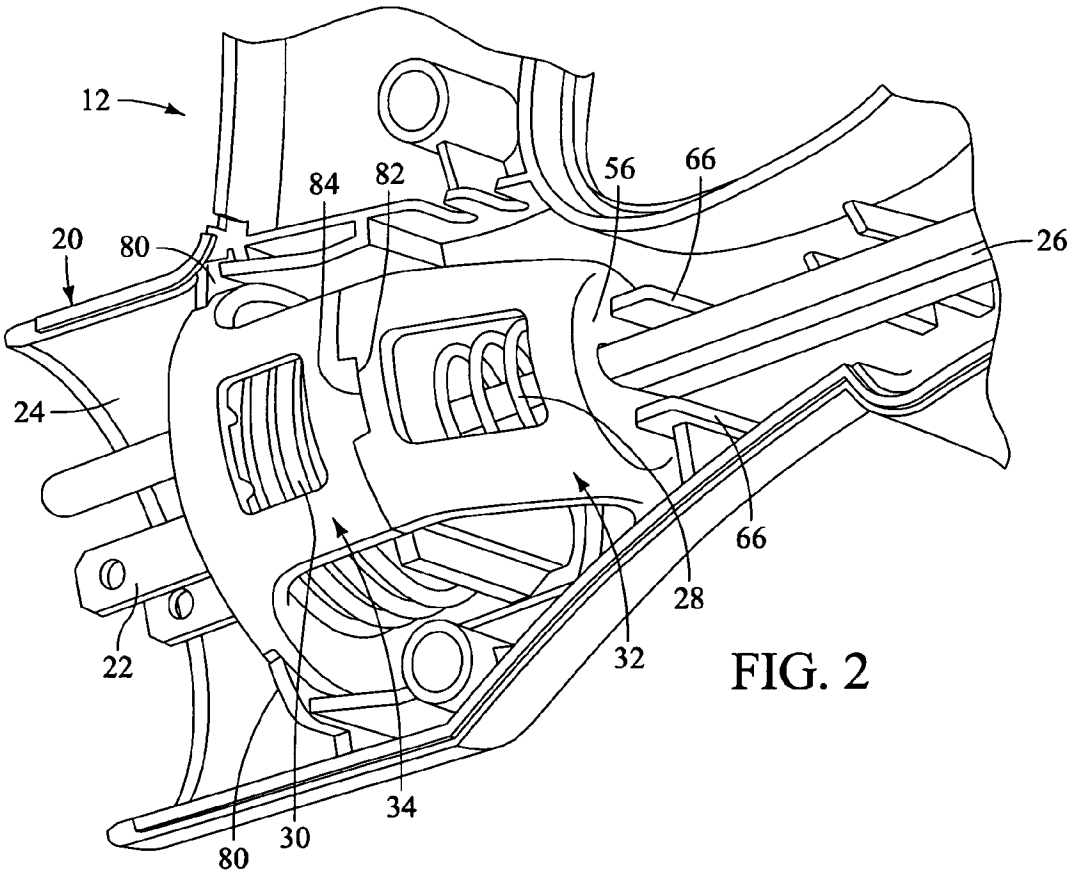
FIG. 2 is a side perspective view of the anti-disengagement assembly of FIG. 1 illustrated within a half of a power tool housing.
Figure 4:
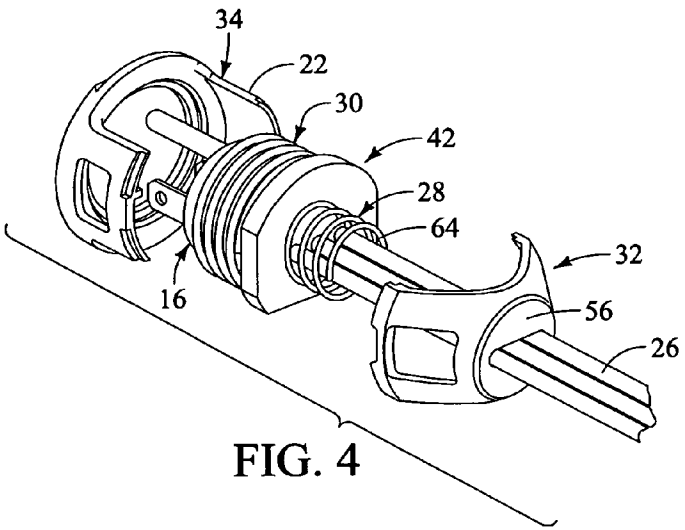
FIG. 4 is an exploded perspective view of the anti-disengagement assembly of FIG. 1.
Figure 3:
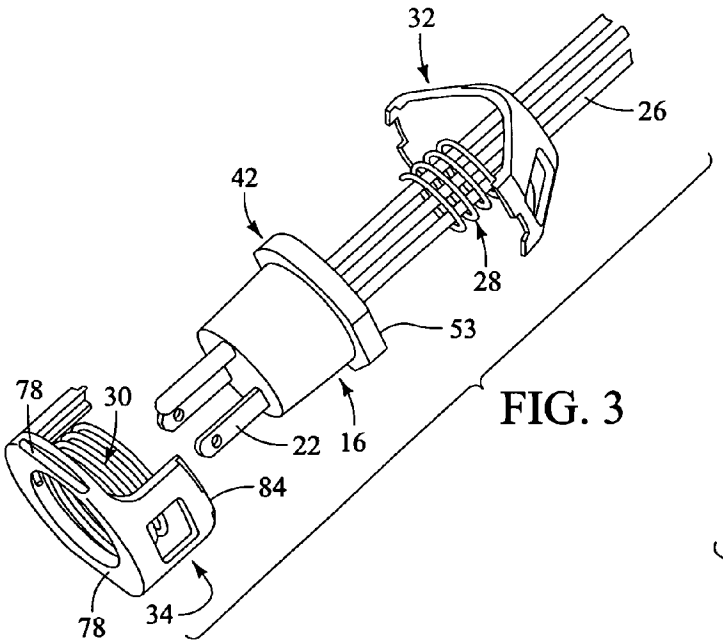
FIG. 3 is an exploded perspective view of the anti-disengagement assembly of FIG. 1.

The housing 12 is typically composed of plastic, such as Acrylonitrile Butadiene Styrene (ABS) or glass-filled nylon, and is assembled from two halves that engage one another in a clam-shell configuration. As illustrated in FIG. 2, each half of the chamber portion 20 includes a plurality of features that promote engagement and retention of the anti-disengagement assembly 10. The anti-disengagement assembly correspondingly includes features that engage the chamber portion 20 of the housing 12.

More particularly, the first preferred embodiment anti-disengagement assembly 10 includes the electrical plug module 16, inner and outer biasing members 28, 30, and inner and outer retaining members 32, 34. Generally, the inner biasing member 28 is configured and arranged to bias the plug module 16 in a first outward direction 36 toward the opening 24 in the chamber portion 20, while the outer biasing member 30 is configured and arranged to bias the plug module in a second direction 38 opposite that of the first direction. The inner and outer biasing member 28, 30 and the plug module 16 that is disposed therebetween are retained within the inner and outer retaining members 32, 34.

The plug module 16, as illustrated in FIGS. 1-4, includes a generally cylindrical body 40 having a first outer circumference, and an end plate 42 disposed at an inner end of the cylindrical body, wherein the end plate has a second outer circumference that is at least slightly larger than the first outer circumference. The outer circumference of the end plate 42 is preferably non-uniform, with an arcuate portion 44 around a portion thereof, as well as a pair of generally parallel planar portions 46 diametrically opposing one another, and a generally flat bottom edge 48. The generally planar portions 46 and the bottom edge 48 are separated by rounded edges 50.

The inner and outer biasing members 28 and 30 are preferably helical compression springs that have a relatively low spring force and small displacement which will enable the plug module to float between the springs, and to slightly move responsive to normal forces that are applied when an extension cord is connected to the plug module 16. This enables the springs to absorb vibration produced by the tool and thereby tend to isolate the plug module 16 from the effects of the vibration. The diameter of the outer biasing member 30 is larger than that of the inner biasing member 28, so it is preferred that the wire size or other force varying parameter be changed to produce generally equal spring forces of the biasing members 28 and 30.

The inside diameter of the outer biasing member 30 is slightly larger than the outside diameter of the body 40 of the plug module 16 so that it can be positioned on it. An inner end 52 of the outer biasing member 28 then abuts an annular shoulder 53 defined by the end plate 42. The inner diameter of the inner biasing member 28 is configured to permit passage of the electrical wires 26, with an outer end 54 of the inner biasing member 28 abutting the end face of the end plate 42.

The plug module 16 of the first preferred assembly 10 "floats" between the inner and outer biasing members 28, 30, with the inner and outer biasing members absorbing vibration to at least partially isolate the plug module from being jarred by the vibration. While it is contemplated that mechanical features of the housing 12 may be provided to retain the inner and outer biasing member 28 and 30, the assembly 10 includes the inner and outer retaining members 32, 34, which when assembled to one another, at least partially enclose the inner and outer biasing members and the floating plug module 16.

Specifically, as illustrated in FIG. 1, the inner retaining member 32 is preferably arcuate in shape, with a generally flat end portion 56 having an orifice 58 to permit passage of the electrical wires 26. Side portions 60 extend from the end portion 56, which may optionally include a window 62 to reduce the overall size of the inner retaining member 32. An inner end 64 of the inner biasing member 28 is configured to abut an inside surface of the end portion 56, while an outside surface of the end portion 56 preferably abuts a pair of ribs 66 extending upwardly from the housing 12.

The outer retaining member 34 is preferably configured to include an outer ring 68 from which curved side members 70 extend rearwardly. As with the inner retaining member 32, one of the side members 70 may optionally include a window 72 to reduce the overall size of the outer retaining member 34. An inner circumference of the outer ring 68 is configured to permit passage of the prongs 22, and an inner surface of the outer ring preferably includes an annular shoulder 74 configured to engage and retain the outer end 76 of the outer biasing member 30. A pair of diametrically opposed, shelves 78 are preferably disposed on the outer ring 68 to engage a correspondingly configured shoulder 80 that extends inward from the housing 12 and prevents rotation of the retaining member 34 relative to the housing.

To promote "floating" of the plug module 16 between the inner and outer biasing members 28, 30, the inner and outer retaining members 32, 34 are configured to engage one another. While the assembly 10 contemplates numerous engagement mechanisms, one exemplary engagement is a snap-fit engagement, and is illustrated in FIG. 2. To this end, the outer end of the inner retaining member 32 preferably includes a generally rectangular recess 82 at each of the side portions 60, while the inner end of the outer retaining member 34 includes correspondingly configured locking extensions 84 on each of the side members 70. In addition, the medial ends of both the inner and outer retaining members 32, 34 may include correspondingly configured arcuate shelves 85*a*, 85*b*, which promote alignment and engagement of the retaining members to one another.

Thus, when assembled, the anti-disengagement assembly 10 includes the inner and outer retaining members 32, 34 connected to one another, with the plug module 16 and inner and outer biasing members 28, 30 disposed between them. The assembly 10 is retained within the chamber portion 20 of the housing 12 with the outside surface of the end portion 56 of the inner retaining member 32 abutting the ribs 66 of the housing, while the shelves 78 of the outer ring 68 engage the annular ring 80. In this manner, the assembly 10 is disposed within the housing 12, with the plug module disposed so as to "float" between the first and second biasing members 28, 30.

Figure 5:
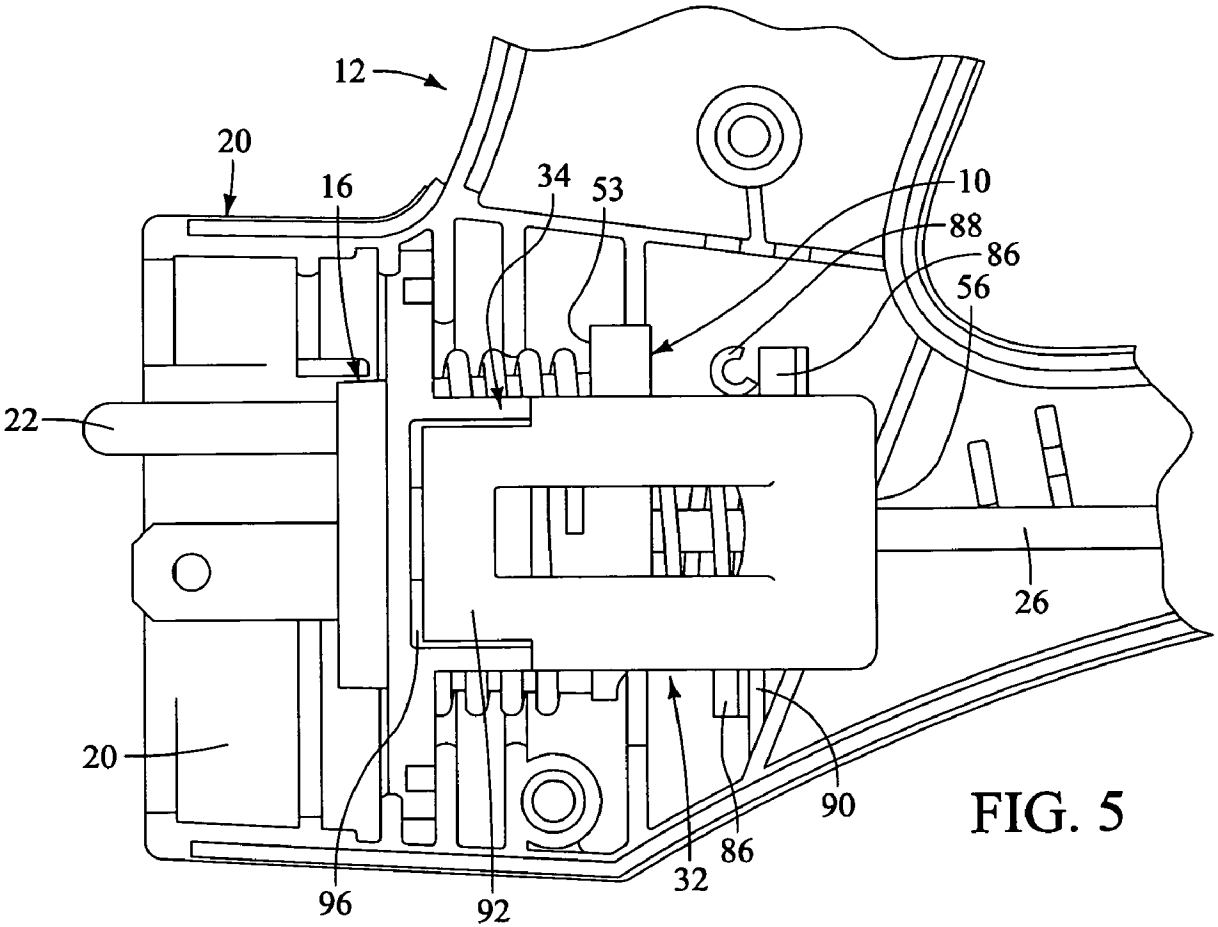
FIG. 5 is a side elevation view of an anti-disengagement assembly according to an alternative embodiment of the invention.
Figure 6:
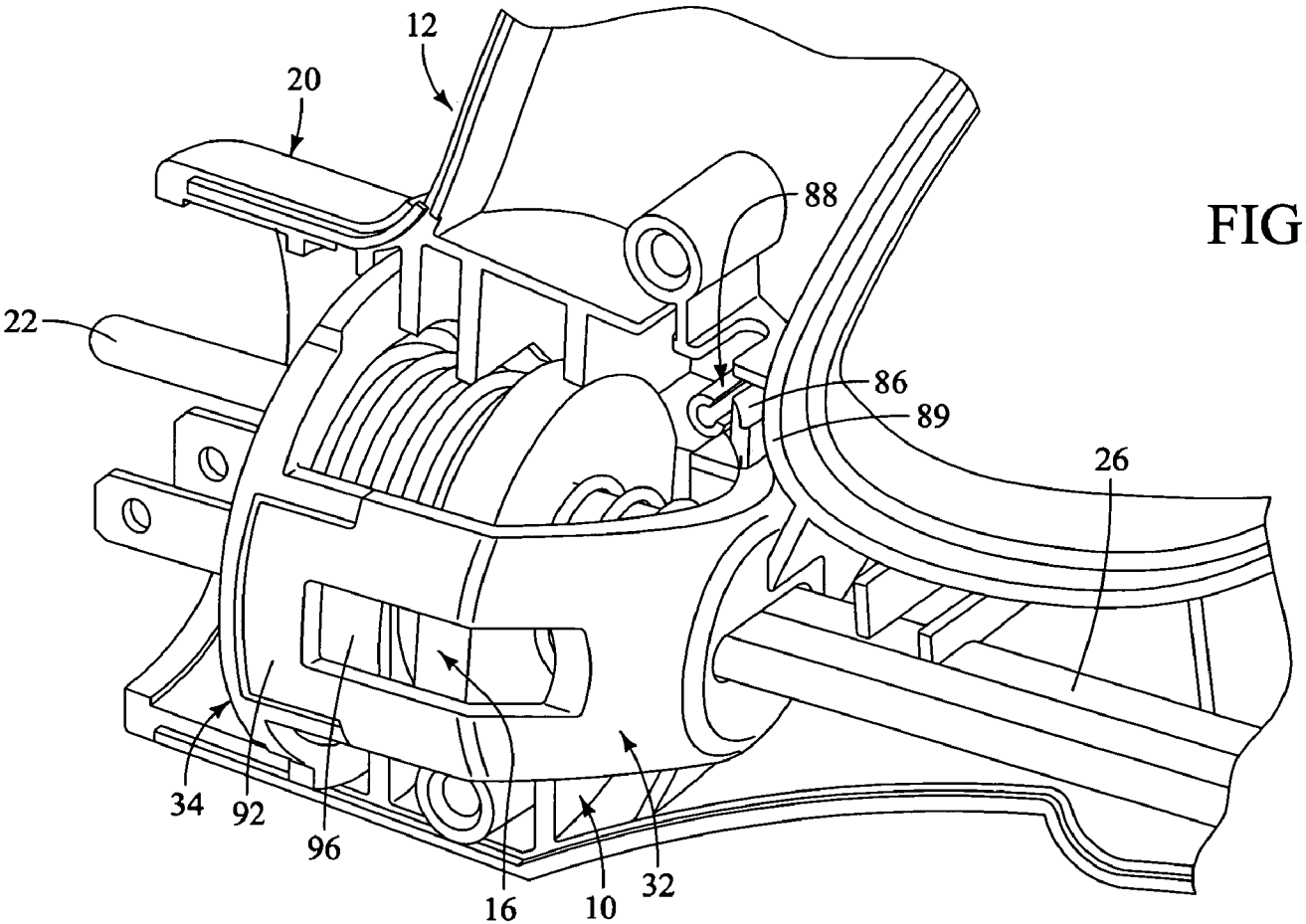
FIG. 6 is a side perspective view of the anti-disengagement assembly of FIG. 5.
Figure 7:
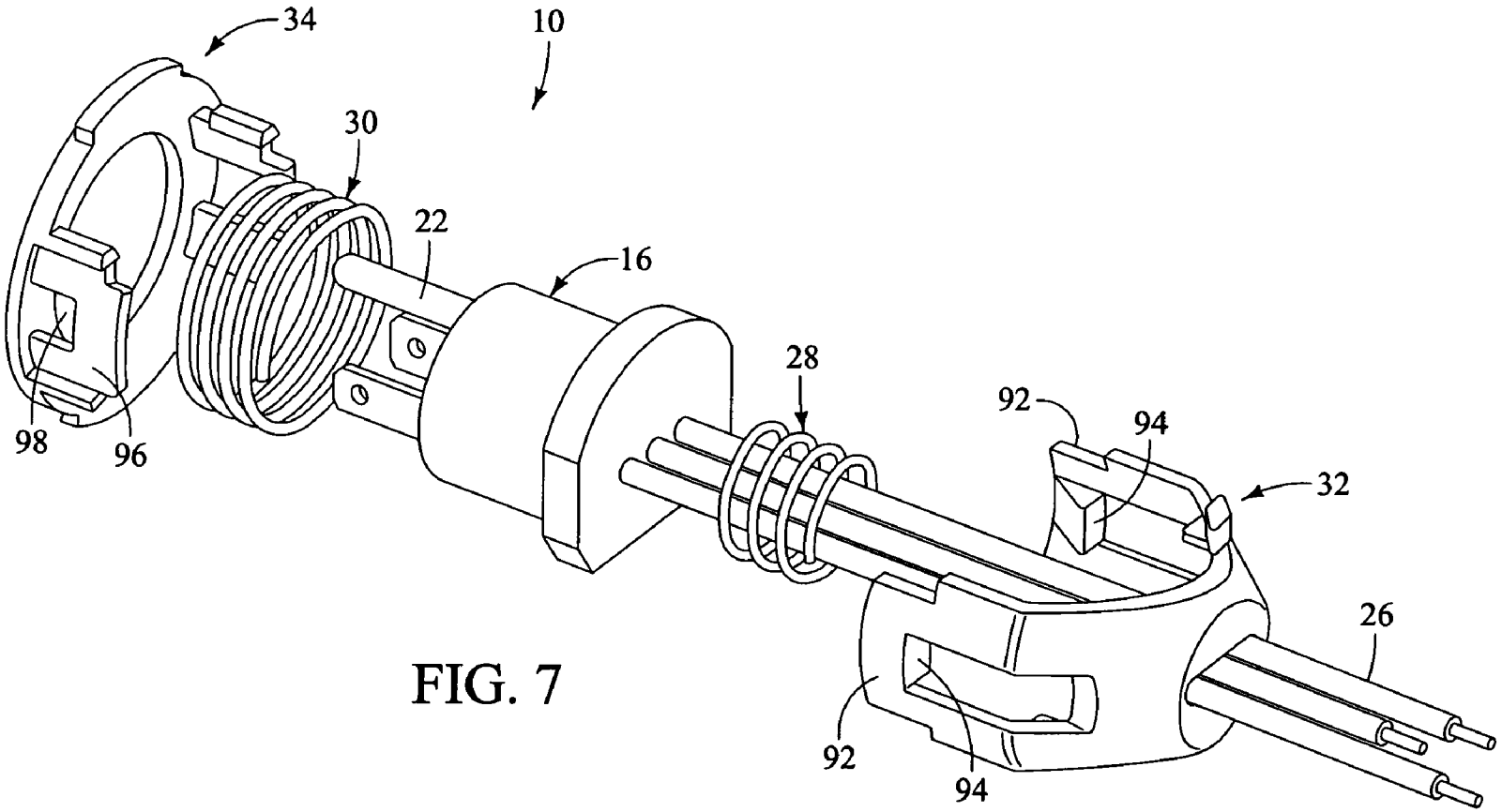
FIG. 7 is an exploded perspective view of the anti-disengagement assembly of FIG. 5.

The assembly 10 may be modified in a variety of ways. For example, the respective structures of the inner and outer retaining members 32, 34 may be modified to provide alternative means of engaging the retaining members to one another, as well as within the housing 12. As illustrated in FIGS. 5-7, the inner retaining member 32 may be configured to include a pair of radial extensions 86 that extend in opposite directions. The radial extensions 86 engage portions of the chamber portion 20 to enhance retention of the inner retaining member 32 within the housing 12. For example, as illustrated in FIG. 5, one radial extension 86 engages a space between a C-shaped projection 88 and a side wall 89 of the housing 12, while the other radial extension abuts a rib 90.

Additionally, the side portions 60 may be extended in length, and instead of recesses, may instead include generally rectangular extensions 92 at the ends thereof, where each of the rectangular extensions includes a wedge-shaped locking member 94 at its underside. Similarly, the side members 70 of the outer retaining member 34 may be shortened, and instead of including extensions, may include generally rectangular depressions 96 configured to frictionally receive the rectangular extensions. Disposed within each of the rectangular depressions 96 is a rectangular window 98 configured to lockingly receive a respective one of the locking members 94 therein. Thus, the inner and outer retaining members 32, 34 may be altered and still be configured to engage one another, as well as to promote retention of the assembly 10 within the housing 12.

Figure 8:
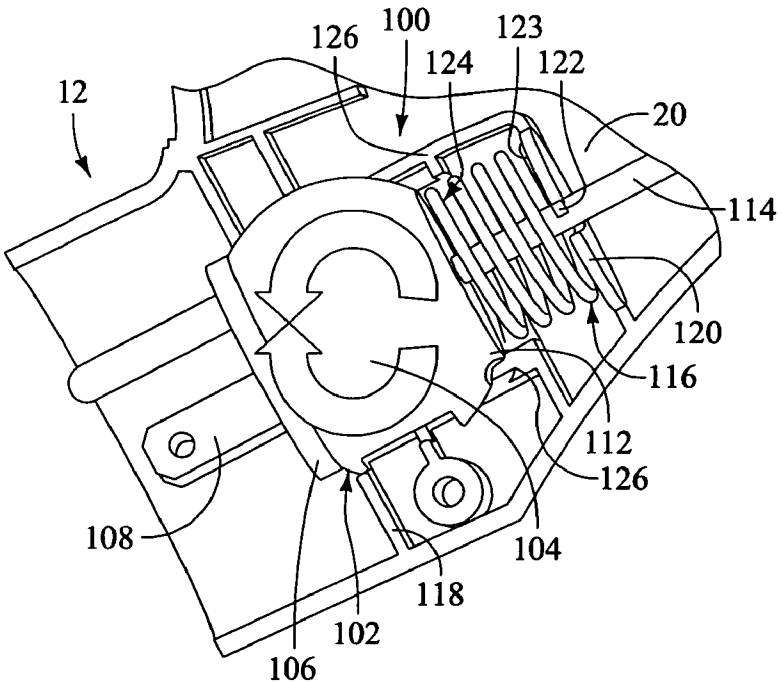
FIG. 8 is a side perspective view of an anti-disengagement assembly according to a second preferred embodiment, illustrated within a half of a power tool housing.

A second preferred embodiment, designated generally at 100 in FIG. 8, includes features to reduce the vibrational impact on the coupling between an extension cord (not shown) and a plug module 102 during operation of a power tool. However, while the plug module 16 of the assembly 10 is configured to float between the two biasing members 28, 30, the assembly 100 of the second preferred embodiment 100 is configured to absorb vibration by at least partially rotating the plug module 102 in response to the vibration.

Figure 9:
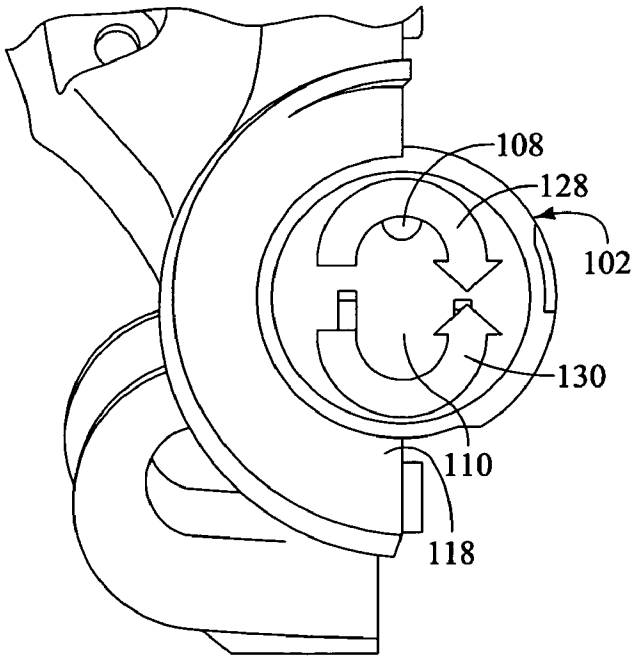
FIG. 9 is a front elevation view of the anti-disengagement assembly of FIG. 8.

To this end, the plug module 102 of the second preferred assembly 100 is-configured to be at least partially rounded to promote rotation within a chamber portion 20' of the housing 12. As illustrated in FIGS. 8 and 9, the plug module 102 includes a generally spherical body 104 with an annular collar 106 disposed at an end thereof, wherein prongs 108 of the plug module extend from a generally planar end 108 defined by the annular collar. A second end 112 of the spherical body 104 opposite the annular collar 106 is also generally flat, with one or more electrical wires 114 extending from it.

Preferably, a single biasing member 116 is provided to bias the plug module 102 in an outward direction. The inclusion of the biasing member 116 is advantageous in that compression and expansion of the biasing member promotes absorption of vibration by the plug module 102. The biasing member 116 may also promote maintenance of the position and orientation of the plug module 102 within the chamber 20. The preferred biasing member 116 is a helical coil.

The chamber portion 20 of the housing 12 is correspondingly configured to both retain the second preferred assembly 100, as well as to bias the plug module 102 in an outward direction. More particularly, an annular ring 118 extends radially inwardly from an inner circumference of the chamber portion 20. In this manner, the inner circumference is reduced at a predetermined location and is sized to permit passage of the annular collar 106, but prevents passage of a majority of the spherical body 104. Thus, a portion of the spherical body 104 is in abutment with the annular ring 118 of the housing 12.

A generally circular plate 120 is disposed at an inner end of the chamber portion 20, and an inner end 124 of the biasing member 116 abuts an outer surface 123 of the circular plate. An outer end 124 of the biasing member 116 abuts the second end 112 of the plug module 102. In addition, guide ribs 126 extend from the chamber portion 20 to promote maintenance of the orientation of the biasing member 116 within the chamber portion 20, and to help reduce distortion of the biasing member 116 as it is compressed.

Thus, when assembled, the second preferred assembly 100 includes the biasing member 116 biasing the plug module 102 outwardly. The assembly 100 is retained at an outer end by the annular ring 118, and at an inner end by the circular plate 120. The biasing member 116 absorbs the axial vibration of the spherical body 104, while permitting compression sufficient to allow the spherical body to rotate in both clockwise and counterclockwise directions 128, 130 relative to the axial lengthwise direction of the biasing member 116, thereby maintaining a position of the plug module 102 and its engagement with the extension cord.

A third preferred embodiment of the invention is especially advantageous in applications involving portable power tools, and includes both an anti-vibration assembly as well as a cord retaining system. While the anti-vibration assembly of either the first or second preferred embodiment minimize vibration induced disengagement of an extension cord from a plug module, a portion of the extension cord external to the chamber 20 of the housing 12 is susceptible to being pulled or snagged during movement of the tool during operation. Accordingly, the third preferred embodiment includes a cord retaining system for releasably retaining a portion of the cord in close proximity to the tool housing 12 to reduce the possibility that the extension cord will be inadvertently pulled or snagged and subsequently result in disengagement of the extension cord from the plug module.

Figure 10:
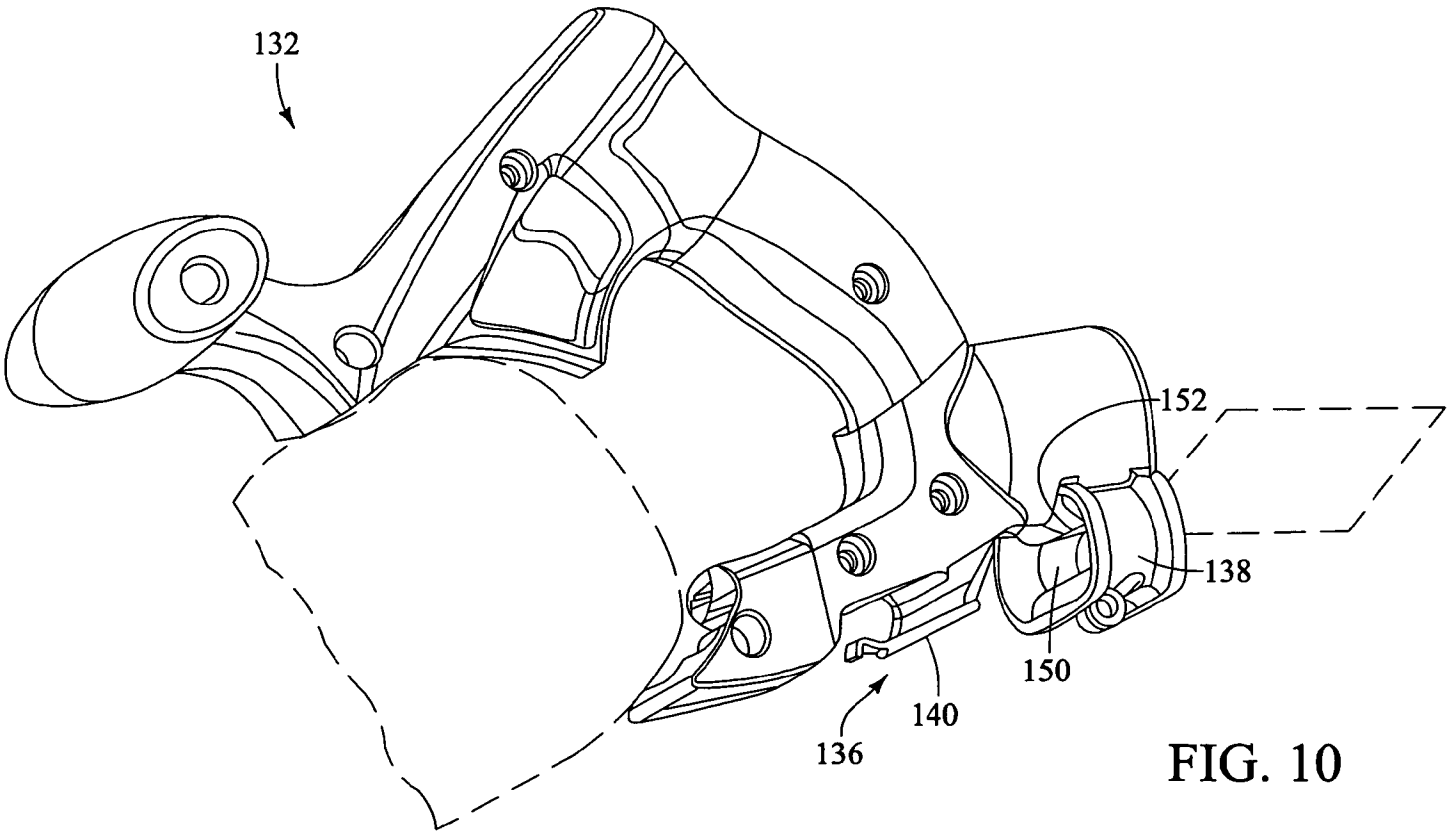
FIG. 10 is a front perspective view of a tool handle incorporating an exemplary cord retaining system.
Figure 11:
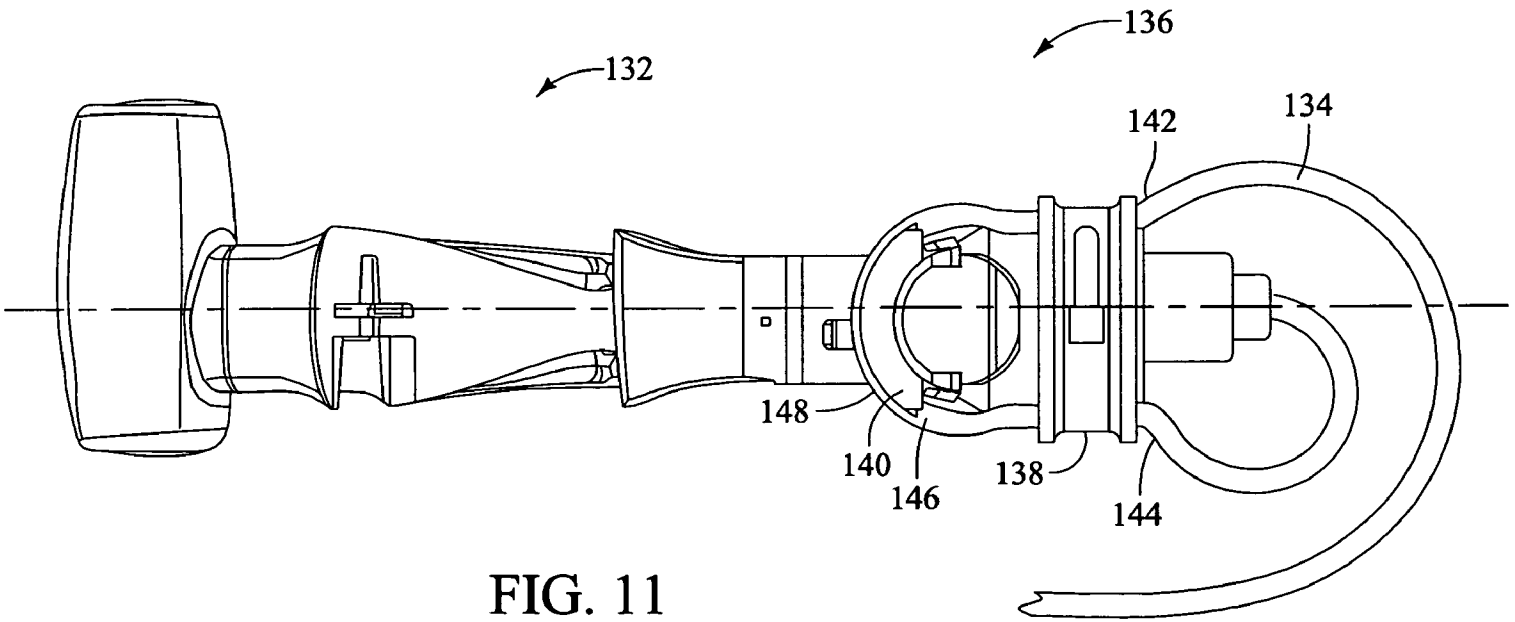
FIG. 11 is a bottom view of the tool handle of FIG. 10 shown with an extension cord in place.

While the invention contemplates that a variety of configurations will suffice to provide retention of the extension cord, an exemplary cord retaining system is illustrated in FIGS. 10 and 11. This cord retaining system is provided by U.S. Pat. No. 7,125,277, issued Oct. 24, 2006 and is hereby incorporated by reference. A power tool generally designated at 132 is shown fragmentarily, and is contemplated as being any one of a group of commonly known portable electric power tools, including, but not limited to drills, hammer drills, sanders, grinders, circular saws, reciprocating saws, routers, power fastener drivers, garden weed trimmers, leaf blowers and the like, all being commercial or homeowner-type power tools commonly used with an extension cord, generally designated 134 (best seen in FIG. 11). The length of the cord 134 may vary, as well as its gauge or diameter and still be suitable for use with the present invention. However, for commercial applications, the extension cord 134 will typically be made of 10, 12 or 14 gauge wires in a cord.

The exemplary cord retaining system, generally designated 136, is secured to a handle portion of the housing 12 by being integrally molded thereto, or alternatively adhered by chemical adhesives or threaded fasteners. Two main components make up the cord retaining system 136, which are a cord capture formation 138 and a cord channel 140. The cord capture formation 138 is configured to retain the extension cord 134 disposed on the housing 12, and the cord channel 140 is disposed on an outside surface of the housing and is configured for supporting a loop of the cord substantially along an arc defined by the loop. The cord capture formation 138 is configured for retaining the extension cord 134 at two or more points of contact 142, 144 (FIG. 11), with a loop portion 146 of the cord formed between the two points. The cord channel 140 receives and supports an apex 148 of the loop portion 146.

More specifically, the cord capture formation 138 is configured to define an enclosed space 150 when attached to the housing 12. Thus, the cord capture formation 138 may define a circular, oval, free form or other preferably non-cornered shape on its own or using a portion 152 of the housing 12. A non-cornered shape is preferred to avoid sharp edges which may cause wear or stress on the extension cord 134. Further, the cord capture formation 138 is configured for maintaining an orientation of the cord 134 that prevents bends and kinks in the cord when the cord is retained in the system 136.

Figure 12:
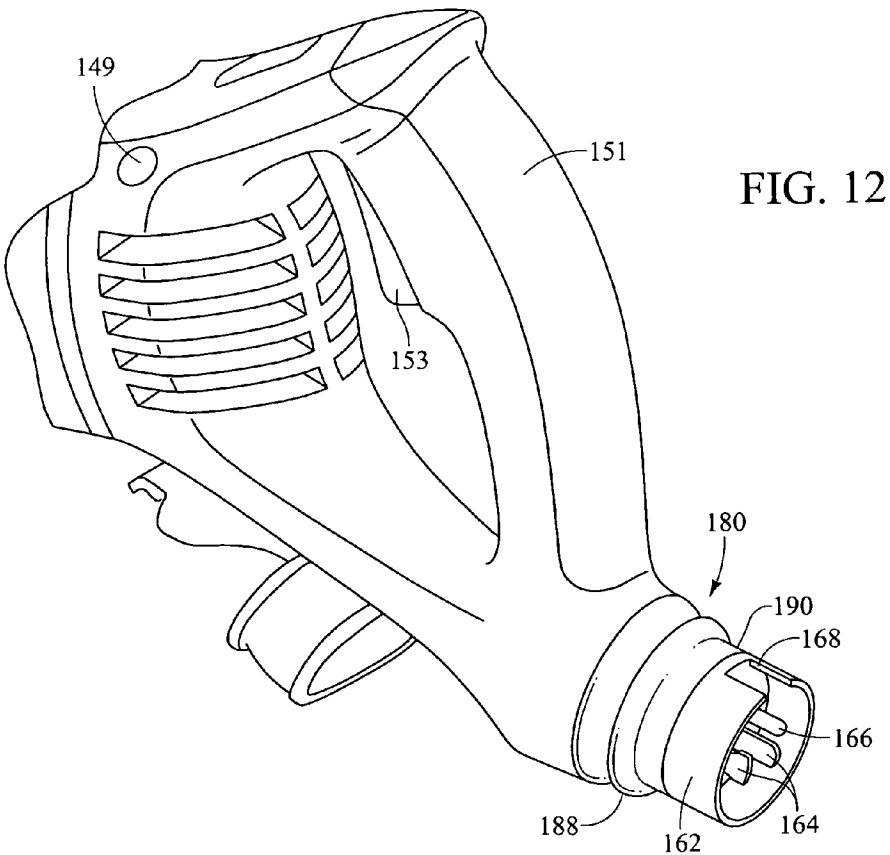
FIG. 12 is a left rear projection of a portion of a tool illustrating a fourth preferred embodiment of an anti-disengagement assembly.
Figure 13:
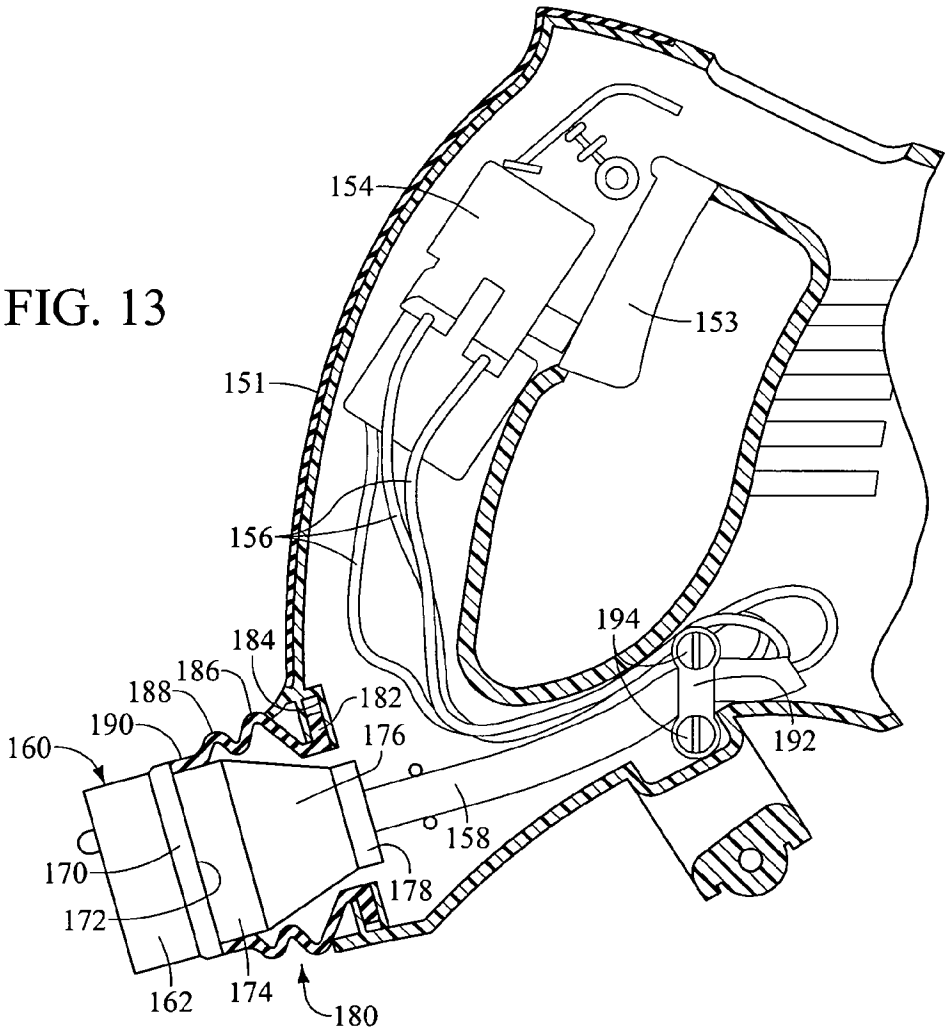
FIG. 13 is a side view, partially in section and with portions removed of the fourth preferred embodiment of an anti-disengagement assembly shown in FIG. 12.

A fourth embodiment of the present invention is shown in FIGS. 12 and 13, in a reciprocating saw having a motor 149 and a handle portion 151 with a trigger 153 that is operatively connected to a switch 154, that has electrical conductors 156 that are part of a cord 158 that extends to a plug module, indicated generally at 160. The plug module 160 has a generally cylindrical outer portion 162 that surrounds two electrical prongs 164 and a ground prong 166, to which an extension cord may be connected. It should be understood that the plug module 160 may be configured to have only the two electrical prongs 164 in some applications. A cutout 168 in the upper part of the outer portion 162 is provided to give a user a visual indication of whether the extension cord is fully plugged into the plug module 160. The plug module 160 has an enlarged annular ring 170 that defines a transverse shoulder 172 and a smaller diameter rear portion 174 that merges with a conical portion 176 and a small cylindrical portion 178 which connects to the cord 158. It should also be understood that while the embodiment shown and described above is preferably molded as a single unit, an alternative configuration may employ a simple off the shelf electrical plug and cord that is supported by a retaining member structure (broadly similar to the retaining members 32 and 34 shown in FIG. 1) that would float within the rubber spring 180. Such an alternative configuration retaining member structure could have a generally cylindrical outer portion with a cutout similar to the cylindrical outer portion 162 having the cutout 168.

An annular rubber spring, indicated generally at 180, is provided and has a flat annular base portion 182 that fits within an annular slot 184 defined by the housing 150. In this regard, the housing is preferably made of a hard durable plastic or plastic like material and is formed by two mating clamshell portions. The slot 184 is preferably formed in each of the clamshell portions so that the rubber spring 180 can be placed in the slot 184 prior to combining the housing portions together which will securely hold the spring captive in the slot 184. The spring 180 has two corrugated portions 186 and 188, the latter of which merges into a cylindrical portion 190 that is sized to snugly fit on the cylindrical portion 174 and to bear against the shoulder 172. However, an additional number of corrugations may also be provided, if desired.

The spring is preferably compressed, i.e., the plug module 160 is pulled to the right as shown in FIG. 13. The compression is achieved by a cord clamp 192 that compresses the cord 158 against a support surface when two screws 194 are tightened. Of course the cord 158 needs to be pulled to the right so as to compress the spring 180 before the cord clamp 192 is tightened. The compression of the spring 180 creates a force applied to the plug module 160 tending to straighten it out if pulled to the side by an extension cord that is plugged into the plug module 160. The combination of the flexible cord 158 and rubber spring 180 isolates vibration that is generated by the tool and reduces the likelihood that the extension cord will separate from the plug module 160. An alternative configuration can be used which eliminates the compression on the spring. In that configuration the cord is not pulled to the right to place the spring 180 in compression before it is clamped by cord clamp 192 and the rubber spring 180 would be able to move more freely, which may increase the isolation from vibration generated by the tool.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A power tool assembly for coupling with an electrical extension cord having a receptacle portion to minimize vibration and disengagement of the electrical extension cord from a power tool that has a housing, a motor and a motor switch, said assembly comprising:

a plug module having a prong configuration for connecting with the receptacle portion of the extension cord and an integral flexible cord for operative connection to the motor switch;

a corrugated resilient sleeve surrounding a rear portion of the plug module, said sleeve further comprising an inner end retained within the housing and an outer end that engages an annular shoulder of said plug module.

2. A power tool assembly as defined in claim 1 wherein said corrugated portion comprises at least two annular corrugations, said corrugations permitting at least axial movement of said plug module relative to the housing.

3. A power tool assembly as defined in claim 2 wherein said corrugations hold said plug module in a predetermined orientation relative to the housing, said corrugations permitting temporary changing of said orientation.

4. A power tool assembly as defined in claim 1 further comprising a cord clamp for clamping the cord to the housing so that the plug module cannot extend away from the housing when it is in a clamped condition.

5. A power tool assembly as defined in claim 4 wherein the cord is pulled inwardly to pull the plug module inwardly before the cord clamp is tightened to a clamped condition.

6. A power tool assembly for coupling with an electrical extension cord having a receptacle portion to minimize vibration and disengagement of the electrical extension cord from a power tool that has a housing, a motor and a motor switch, said assembly comprising:

a plug module having a prong configuration for connecting with the receptacle portion of the extension cord and an integral flexible cord for operative connection to the motor switch;

a corrugated resilient sleeve surrounding a rear portion of the plug module, said sleeve further comprising an inner end retained within the housing and an outer end that engages an annular flange shoulder of said plug module, said corrugated portion comprises at least two annular corrugations which permit at least axial movement of said plug module relative to the housing, and said corrugations hold said plug module in a predetermined orientation relative to the housing, said corrugations permitting temporary changing of said orientation;

wherein said plug module has a cylindrical extension that extends outwardly to the outer end portions of said prongs, said extension including a cutout that enables a user to view the connection of the receptacle portion and the prongs and determine whether the extension cord is fully plugged into the plug module.

7. A power tool assembly for coupling with an electrical extension cord having a receptacle portion to minimize vibration and disengagement of the electrical extension cord from a power tool that has a housing, a motor and a motor switch, said assembly comprising:

a plug module having a prong configuration for connecting with the receptacle portion of the extension cord and an integral flexible cord for operative connection to the motor switch;

a corrugated resilient sleeve surrounding a rear portion of the plug module, said sleeve further comprising an inner end retained within the housing and an outer end that engages an annular flange shoulder of said plug module;

wherein the housing has an annular recess adjacent said sleeve, said inner end of said sleeve having a outer transverse annular flange that fits within said housing annular recess.

8. A power tool assembly for coupling with an electrical extension cord having a receptacle portion to minimize vibration and disengagement of the electrical extension, cord from a power tool that has a motor and a motor switch, said assembly comprising:

a tool housing for containing the motor therein;

a plug module having a generally cylindrical overall configuration and a first end portion with a prong configuration for connecting with the receptacle portion of the extension cord;

a flexible electric cord connected to said plug module and to said prong configuration thereof, said cord extending from a second opposite end portion of said plug module and being operatively connected to the motor switch;

a corrugated resilient sleeve surrounding a rear portion of the plug module, said sleeve further comprising an inner end retained within the housing, said sleeve holds said plug module with sufficient force to hold said plug module at a predetermined orientation, but permits at least limited transverse movement of the plug module in said sleeve, thus minimizing vibration of an electrical plug module, said corrugated resilient sleeve further comprising a cylindrical outer end portion that engages an annular shoulder of said plug module.

9. A power tool assembly as defined in claim 8 wherein the housing has an annular recess adjacent said flexible spring-like mounting assembly, said inner end of said mounting assembly having a outer transverse annular flange that fits within said housing annular recess.

10. A power tool assembly as defined in claim 8 further comprising a cord clamp for clamping the cord to the housing so that the plug module cannot extend away from the housing when it is in a clamped condition.

11. A power tool assembly as defined in claim 8 wherein said corrugated portion comprises at least two annular corrugations, said corrugations permitting at least axial movement of said plug module relative to the housing.

12. A power tool assembly as defined in claim 11 wherein said corrugations hold said plug module in a predetermined orientation relative to the housing, said corrugations permitting temporary changing of said orientation.

13. A power tool assembly for coupling with an electrical extension cord having a receptacle portion to minimize vibration and disengagement of the electrical extension cord from a power tool that has a motor and a motor switch, said assembly comprising:

a tool housing for containing the motor therein;

a plug module having a generally cylindrical overall configuration and a first end portion with a prong configuration for connecting with the receptacle portion of the extension cord;

a flexible electric cord connected to said plug module and to said prong configuration thereof, said cord extending from a second opposite end portion of said plug module and being operatively connected to the motor switch;

a resilient corrugated sleeve mounting assembly retained by said housing and holding said plug module with sufficient force to hold said plug module at a predetermined orientation but permits at least limited transverse movement of the plug module in said mounting assembly for minimizing vibration of an electrical plug module, said resilient corrugated sleeve mounting assembly comprising an inner end that is retained by said housing and an outer end that includes a corrugated portion and a cylindrical outer end portion with an end surface that engages an annular shoulder of said plug module;

wherein said plug module has a cylindrical extension that extends outwardly to the outer end portions of said prongs, said extension including a cutout that enables a user to view the connection of the receptacle portion and the prongs and determine whether the extension cord is fully plugged into the plug module.

14. A method of increasing the holding force applied to power tool assembly for coupling with an electrical extension cord having a receptacle portion to minimize vibration and disengagement of the electrical extension cord from a power tool that has a housing, a motor and a motor switch, and wherein the power tool assembly comprises a plug module having a prong configuration for connecting with the receptacle portion of the extension cord and an integral flexible plug module cord for operative connection to the motor switch, a cord clamp for clamping the cord to the housing so that the plug module cannot extend away from the housing when it is in a clamped condition, a corrugated resilient sleeve surrounding a rear portion of the plug module, said sleeve comprising an inner end retained within the housing and an outer end that engages an annular flange shoulder of said plug module, said method comprising pulling the plug module cord inwardly so as to pull the plug module inwardly; and tightening the cord clamp.

* * * * *